United States Patent [19]

Lemons

[11] Patent Number: 4,536,832

[45] Date of Patent: Aug. 20, 1985

[54] REPLACEABLE LIGHT SOURCE ASSEMBLY

[75] Inventor: Thomas M. Lemons, Marblehead, Mass.

[73] Assignee: Altman Stage Lighting Co., Inc., Yonkers, N.Y.

[21] Appl. No.: 608,390

[22] Filed: May 9, 1984

Related U.S. Application Data

[63] Continuation of Ser. No. 394,277, Jul. 1, 1982, abandoned.

[51] Int. Cl.[3] ..... F21P 5/02; F21M 7/00

[52] U.S. Cl. ..... 362/264; 362/218; 362/268; 362/289; 362/294; 362/296; 362/309; 362/310; 362/311; 362/328; 362/339

[58] Field of Search ..... 362/210, 217, 218, 220, 362/223, 257, 261, 262, 263, 265, 265, 267, 268, 285, 289, 294, 296, 307, 308, 309, 310, 311, 328, 329, 333, 334, 339, 340, 343, 345, 362, 368, 372, 373, 416; 313/25, 43, 113

[56] References Cited

U.S. PATENT DOCUMENTS

| | | | |
|---|---|---|---|
| 1,364,866 | 1/1921 | Champeau | 362/309 |
| 1,799,899 | 4/1931 | Heile | 362/341 |
| 1,845,214 | 2/1932 | Arrousez | 362/297 X |
| 1,922,036 | 8/1933 | Gruber | 362/261 |
| 2,057,278 | 10/1936 | Richardson | 362/277 |
| 2,901,648 | 8/1959 | Linsday et al. | 313/25 |
| 2,904,714 | 9/1959 | Wiley | 362/310 X |
| 3,255,345 | 6/1966 | Chadwick | 362/218 |
| 3,366,784 | 1/1968 | Hilzen | 362/265 |
| 3,379,868 | 4/1968 | Taillon | 362/263 |
| 3,381,125 | 4/1968 | Cooper | 362/263 |
| 3,428,800 | 2/1969 | Levin et al. | 362/309 |
| 3,541,492 | 11/1970 | Fenn | 362/294 X |
| 3,560,728 | 2/1971 | Atkin | 362/294 |
| 3,676,667 | 7/1972 | Malifaud | 362/301 |
| 3,751,657 | 8/1973 | Sangiamo et al. | 362/294 |
| 3,852,582 | 12/1974 | Lowell | 362/218 X |
| 4,002,894 | 1/1977 | Kintz | 362/261 |
| 4,183,077 | 1/1980 | Arnold | 362/210 X |

FOREIGN PATENT DOCUMENTS

| | | | |
|---|---|---|---|
| 766615 | 9/1967 | Canada | 362/218 |
| 787769 | 6/1968 | Canada | 362/263 |
| 2362367 | 6/1975 | Fed. Rep. of Germany | 362/311 |
| 3034298 | 4/1982 | Fed. Rep. of Germany | 362/263 |
| 1494768 | 8/1967 | France | 362/290 |
| 198432 | 9/1965 | Sweden | 362/294 |
| 1060533 | 3/1967 | United Kingdom | 362/218 |
| 1157764 | 7/1969 | United Kingdom | 362/311 |
| 1201894 | 8/1970 | United Kingdom | 362/294 |

*Primary Examiner*—David H. Brown
*Assistant Examiner*—John E. Griffiths
*Attorney, Agent, or Firm*—Barlow & Barlow Ltd.

[57] ABSTRACT

A replaceable light source assembly is particularly designed for use in a projector housing with sources such as an HMI arc lamp or tungsten halogen lamp where the light source is contained within an envelope. Basically, the light source is closely spaced to a substantially flat mirror which images the light source around the source to produce the effect of a multiplicity of sources. In effect, the light source and its mirror image produces a beam pattern which may be projected towards a suitable projection lens, the light source and mirror are fastened to a heat sink structure to dissipate heat, and the assembly has suitable electrical connections to fit existing housings.

1 Claim, 7 Drawing Figures

REPLACEABLE LIGHT SOURCE ASSEMBLY

This is a continuation of application Ser. No. 394,277, filed July 1, 1982 now abandoned.

BACKGROUND OF THE INVENTION

The illumination required for motion pictures and television has changed drastically over the years. The first motion pictures were shot in daylight. The mercury arc and open carbon arc's were the first artificial light sources used. The introduction of the incandescent lamp resulted in film being developed that was compatible with this warm source as opposed to the cool daylight quality of previous sources. The development of this film lead to the development of a carbon arc with a warm, incandescent color quality rather than just the cool, daylight color. The development of xenon lamps in the 1950's and 60's with their near perfect daylight color resulted in their being applied to film and TV illumination.

As TV broadcasting developed during the 50's and 60's, it used the lighting systems then being used for film that included daylight, carbon arcs, xenon, and incandescent. In the 60's, the incandescent lamp was improved with the introduction of the tungsten-halogen lamp. The desire for dimming prominent in TV studios, but not film studios, led to the predominant use of the tungsten-halogen incandescent lamp for TV studio applications. This was necessary since carbon arc's and xenon lamps are not easily dimmed.

During the 70's the development of fast film and easily portable TV cameras led to an increased desire to shoot pictures outside the studios. Since daylight was often present, the desire was for the development of a light source that was easily portable and had a daylight color. The carbon arc and xenon lamps required direct current which required a separate generator. This limited the ease of their use and portability. Since the available power was often limited, the source should also have as high a luminous efficacy as possible from a small source for optical control. This resulted in the development of the HMI metal halide lamp which has a near perfect daylight color, compact source and as much as 100 lumens per watt. Compared to the similar appearing compact xenon lamp, the HMI metal halide lamp has up to $2\frac{1}{2}$ times the efficacy (40 vs 100 lpw).

The HMI lamp has been developed in wattages ranging from 200 to 6000 watts and operated off any alternating current available source of power. A recent development in this lamp type has resulted in an incandescent quality metal halide lamp, whose luminous efficacy is about 3 times that of an incandescent lamp. Other metal halide lamps with different configurations have also been developed, termed CSI and CID. These lamps are available in open configurations as well as sealed into a PAR 64 reflector lamp which replaces a PAR 64 1000 watt tungsten-halogen lamp.

The construction of the HMI metal halide lamp involves a central arc chamber of thick quartz with two long legs extending out along the lamp axis. The long legs are necessary to accomplish a tight seal between the quartz envelope and metal electrical lead. The lamps, especially the higher wattages, have a high current which produces high temperatures in these seals which must be limited to about 300 degrees C. at the point where electrical contact is made. The temperature in the arc chamber, on the other hand, must be at least 600 degrees C. to obtain the desired color quality.

The CSI and CID lamp uses a press seal where metal ribbons are sealed into quartz. A 300 degrees C. limit at the lower end of the press is again desirable, especially when the lamp is not sealed into an inert atmosphere inside a PAR 64 lamp. Their quartz envelope is not as thick as the HMI lamp envelope, but a 600 degrees C. bulb wall temperature is present.

To help reduce the seal temperatures of all of these lamps, the electrical contact elements are often massive heat sinks with cooling fins. Forced cooling could help, but it would be an added noise producing consideration since the lights and microphones are often in close proximity. The thermal characteristics of the luminaires and sockets are therefore an important consideration.

The most common luminaire used for film and TV illumination is the fresnel lens spotlight of the type seen in the Richardson U.S. Pat. No. 2,057,278. Such luminaires were developed for the incandescent lamp and used a spherical reflector to reimage the filament back through the openings in the filament to make the beam pattern more uniform and more efficient. When a carbon arc or compact xenon arc are used with a fresnel lens, there is no gap in the arc to fill by imaging the arc onto itself with a spherical reflector. These direct current arcs have one large electrode where a point of high brightness exists and a directional pattern of light emits from this point. When a fresnel lens is placed in front of this directional beam, it collects and redirects this beam into the desired spotlight pattern and no auxiliary reflector is needed; see U.S. Pat. No. 1,364,866.

Over the years many luminaires have been developed with carbon arc, mercury arc, xenon arc and incandescent light sources. Some such patented systems have included Arrousez, U.S. Pat. No. 1,845,214; Taillon, U.S. Pat. No. 3,379,868; Richardson, U.S. Pat. No. 2,057,278 and German Utility Model No. 1,744,824 dated May 15, 1957. The most popular luminaires for film and TV lighting have been the Brute Arc which uses the open carbon arc source and a fresnel lens for a high intensity spotlight for both outside, daylight quality light as well as inside, incandescent colored light. For inside use, the incandescent fresnel lens spotlight has been the primary workhorse of the industry.

The creation of the highly efficient, metal halide sources has presented the desire for their use in standard film and TV type luminaires. The creation of these lamps has been accompanied by the creation of special luminaires, but the desire to incorporate the lamps into a fresnel lens spotlight has been a primary desire of the industry. The lack of one bright spot and a directional quality of the source has made any use of these new metal halide lamps in the standard Brute Arc to be ineffective.

The direct replacement of the incandescent lamp with one of the new metals halide lamps produces less than adequate results. Such direct replacement would find the spherical reflector reimaging the arc onto itself without the filament gaps through which the energy passes the reimaging only becomes energy that is absorbed resulting in increased bulb heating. The arc configuration is such that the resultant beam is oval rather than circular, as is the case with the standard fresnel luminaires.

Some fresnel lens luminaires designed for the metal halide lamps change the light source/reflector orientation to image the source around the bulb which reduces the bulb heating and can produce an adequate beam pattern. Improvements are still desired and the potential for retrofitting existing luminaires without bulb temperature problems has been a continued desire of the industry. A method of using the metal halide lamps in the standard luminaires without major reconstruction, bulb overheating, efficiency reduction, light quality sacrifice or other compromises has presented a challenge.

The standard fresnel lens luminaires are not highly efficient. Typically, only about 10 percent of the lamp's energy is collected into the beam of the fresnel luminaire at full spot and 30 percent at full flood. One development of a more efficient fresnel lens spotlight can be seen in the Levin/Lemons U.S. Pat. No. 3,428,800. The new metal halide lamp source size and construction makes this type of system impractical. The only efficient metal halide lamp systems developed to date have been lamp/reflector combinations which do not include the use of a fresnel lens. These systems can be relatively small, light weight, highly efficient and meet all other criteria except the desire for the industry standard fresnel lens type luminaire.

SUMMARY OF THE INVENTION

The instant invention is directed to a replaceable light source assembly that may be used in any existing incandescent fresnel unit that comprises an arc light source fastened to a heat sink structure which has a flat mirror located very close to the light source so that the arc is spaced from the mirror approximately the length of the source. The heat sink is thermally coupled to the quartz electrical lead seal area to reduce seal temperature and maximize lamp life. The heat sink structure has mounting means for engaging an existent lamp socket and the arc is energized through leads that go to a suitable ignition ballast system. The mirror is predominately specular which may be peened for partial diffusion. This arrangement of a flat reflector which is spaced from the source approximately the length of the source does not image the source back onto itself to cause overheating of the source and requisite damage thereto. The flat mirror produces an image of the arc above and below the original arc so that a directional area source is created. In addition by mounting the mirror onto the heat sink structure the high temperature, that is created at the mirror, is properly dissipated. Since the heat sink source has mounting devices attached thereto that grip the quartz legs that encase the electrical leads of the arc source, heat dissipation is controlled at the electrical lead seals thereof.

DESCRIPTION OF THE PREFERRED EMBODIMENT

Figure 1:
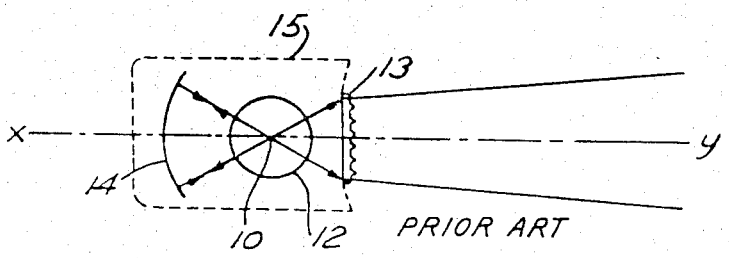
FIG. 1 is a schematic drawing of an illumination system as seen in the prior art.
Figure 2:
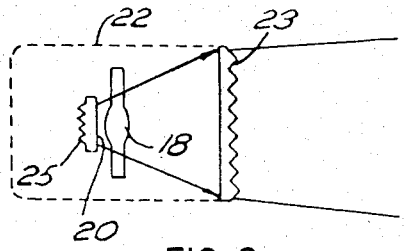
FIG. 2 is a schematic drawing a similar illumination system utilizing the replaceable light source assembly of the instant invention.

Referring to FIG. 1, the typical source used in a spotlight consists of a incandescent source 10 that is contained within an envelope 12 that is situated on a optical axis XY and which has a Fresnel lens 13 and a spherical mirror 14 that is located behind the filament of an incandescent source so that its center of curvature coincides with the filament, the entire optical system being suitably placed within a housing 15.

In the present replaceable light source made in accordance with the invention, there is provided an arc light source 18 and a flat mirror 20, which is closely spaced to the light source 18, all of which is placed within a housing 22 having a Fresnel lens 23. Placing a predominately specular surface of mirror 20 immediately behind the light source 18 gives an image of the source adjacent to the source which effectively allows a lens to see the source twice, that is, it sees the reflection immediately behind the object and the closer that the object gets to the mirror the more these two become one. Also the mirror will image the source out around itself since that flat mirror does not directly image the source back into itself, and the closer one gets to the mirror, the effect is that of looking at two sources, and therefore, there is a circular beam or an area whose length and height can be identical or close to being identical so that there is an area of reflection rather than a line reflection. This is best accomplished by making the distance between the source and the mirror approximately equal to the length of the source. The mirror effectively fills in on either side of the source and puts some light back through the source but not enough to overheat an arc source.

In effect, the mirror 20 is mounted on a heat sink structure which has heat sink fins 25, the entire structure coming to an L-shaped base 26 which is conveniently provided with a pair of mounting pins 28, 29 which are similarly spaced to a bi-pin incandescent source so that it is readily replaceable in existing spotlight fixture. The arc source lamp 18 is made with electrical connecting ends 18', 18" which will be connected to a suitable power source. The tubular ends of the lamp are clamped to a heat sink structure by clamp means 30, 31 which grip the quartz to electrical lead seal area to reduce the seal temperature and maximize lamp life. As seen more particularly in FIG. 4, it will be noted that the mirror 20 is of an elongated shape so that the image of the source is spread vertically to overcome the ovalness of the beam that is emitted from double-ended linear arc light sources. The flat mirror behind the lamp produces an image of the arc above and below the original arc creating a directional, area source, projected into the desired circular beam by the fresnel lens. This flat mirror needs to be as close as possible to the lamp's bulb, presenting the requirement that the heat sink also dissapate heat from the reflector for when it is made of aluminum the reflector may melt. The resultant beam pattern has good uniformity in a circular pattern with good efficiency.

Referring back again to FIG. 3, it will be noted that the conventional form of housing has been illustrated where the normal incandescent mounting means for the lamp is seen diagrammatically by the block 35 that has a threaded bore therethrough which cooperates with a lead screw 36 that is rotatably journalled between a pair of projections 37,38. The lead screw may be adjusted by a knob 39, so that the mounting may be changed relative to the lens 23, and, as is usual in lamp structures of this nature, ventilation holes such as ventilation holes 40 have been provided which had been covered by a suitable light shield such as 41, 42. The electrical leads from the arc source, such as the leads 45, must be suitably insulated and connected to a high voltage ignitor 48 and thence to a ballast and suitable source of power, and as well known to those skilled in the art, the entire lighting fixture may be suitably mounted with yokes or standards such as the standard 50 that is illustrated in the drawings.

Figure 3:
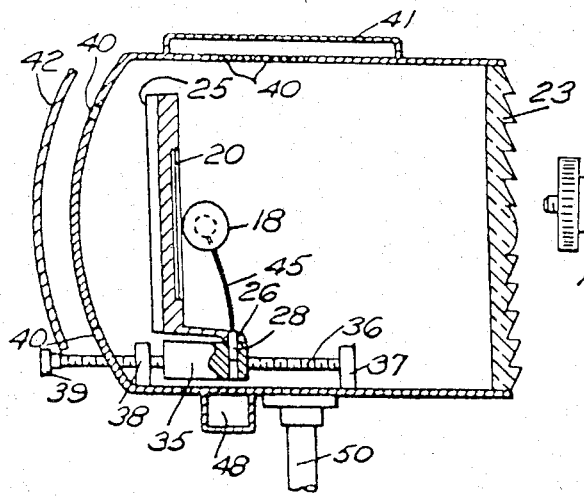
FIG. 3 is a sectional elevational view of a complete lighting system utilizing the light source of the instant invention.
Figure 4:
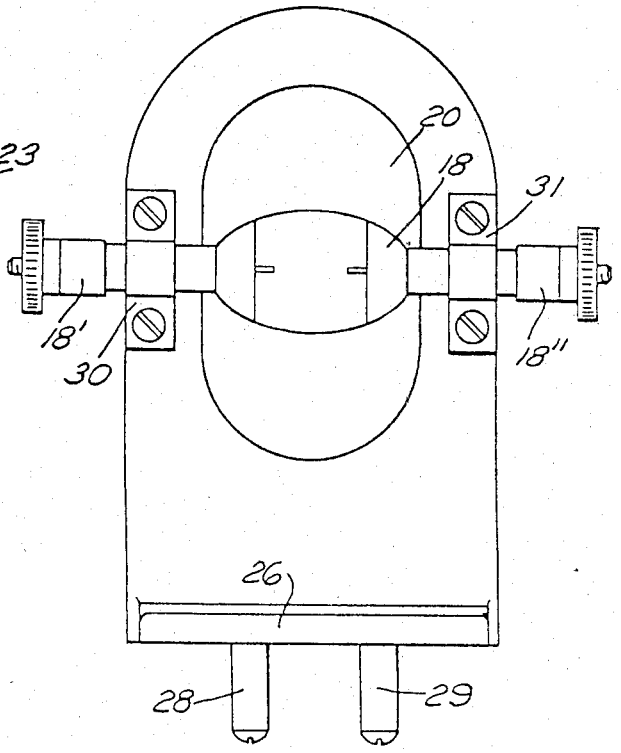
FIG. 4 is a front elevational view of one form of light source and reflecting system mounted on a heat sink structure made in accordance with the present invention.
Figure 5:
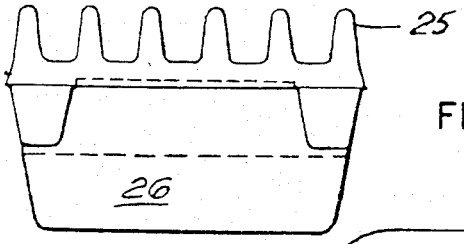
FIG. 5 is a top view thereof with the light source removed.
Figure 6:
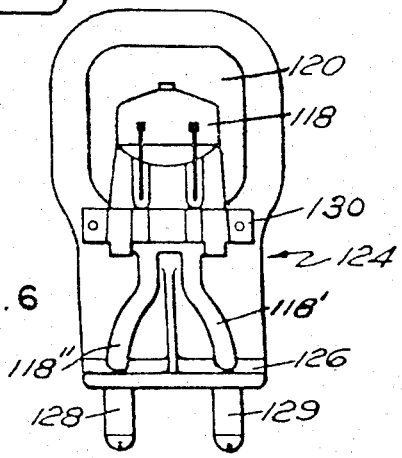
FIG. 6 is a front elevational view of a second form of light source and reflecting system mounted on a heat sink structure made in accordance with the present invention.
Figure 7:
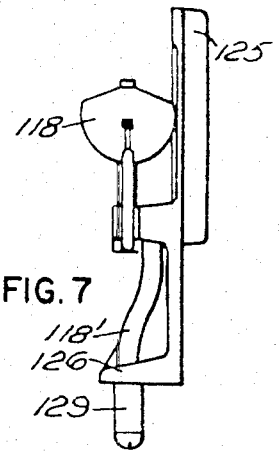
FIG. 7 is a side elevational view thereof.

In FIGS. 6 and 7 there is shown an additional form of arc source in which the electrical leads do not come away from the arc in an axial fashion. While the arc source illustrated in FIGS. 3 and 4 is designted HMI source, forms illustrated in FIGS. 6 and 7 are known in the trade as a CIS/CID source. In this case the illumination assembly includes an arc source 118 that is mounted on a heat sink assembly generally designated 124 by clamps 130. The flat mirror 120 is closely spaced to the light source a distance approximately equal to the length of the source and is physically attached to the heat sink structure 124. Electrical leads coming from the arc source 118 are seen as leads 118' and 118" which go to the bi-pin plug contacts 128 and 129. As will be seen in the drawings, the heat sink structure is provided with heat radiating fins 125 and the entire structure is preferably made from a single casting so as to provide good heat transmission. The clamps 130 directly connect the contact means of the arc source to the heat sink so that heat will be dissipated and the mirror being physically attached to the heat sink will also be suitably cooled so that it can operate properly in the environment of a high temperature created by the proximity thereof to the arc. As in the previous embodiment, the mirror images the source out and around itself and effectively fills in on either side of the source as well as putting some light back in through the source but not enough to overheat the arc source so that a good circular beam may be readily produced when the light source is put into an existing fixture such as that disclosed in FIG. 3. I claim:

1. A replaceable light source assembly for a spotlight having a housing, lens and lamp socket comprising a quartz envelope with reduced diameter tubular portions protruding from opposite ends thereof, said envelope having two arc electrodes therein comprising an arc light source, said tubular portions containing electrical leads of a length greater than the tubular portions, said leads extending away from the arc electrodes and sealed within said tubular portions, said electrical leads having connection portions extending exterior to the envelope, a heat sink structure having an L-shaped base portion provided with mounting means for engaging an existing lamp socket and a body extending vertically therefrom with a rear face and a front face, a plurality of heat radiating fins on the rear face, a substantially flat continuous mirror affixed to said front face of said heat sink structure, clamps fastening said quartz envelope to said heat sink structure on the front face in front of the mirror so that the light source is spaced from the mirror substantially the length of the source, said clamps engaging the tubular portions of the quartz envelope so as to create a heat conductive path and dissipate heat from the tubular portions, said mirror having a vertical length longer than the horizontal length to define an elongated shape the vertical length being transverse to the axis between the arc electrodes, said source being positioned by said clamps midway of the vertical length of the mirror and being imaged in said mirror to produce an effect of at least two sources, said elongated mirror producing substantially a circular beam.

* * * * *